United States Patent [19]

Kinney

[11] B 3,994,117

[45] Nov. 30, 1976

[54] METHOD AND APPARATUS FOR FILLING CONTAINERS

[75] Inventor: Alfred W. Kinney, Kansas City, Mo.

[73] Assignee: Phillips Petroleum Company, Bartlesville, Okla.

[22] Filed: Sept. 24, 1974

[21] Appl. No.: 508,878

[44] Published under the second Trial Voluntary Protest Program on February 3, 1976 as document No. B 508,878.

[52] U.S. Cl. ..... 53/77; 53/282; 141/94; 141/172; 141/277; 141/374

[51] Int. Cl.[2] ..... B65B 3/36; B65B 3/24; B65B 57/00

[58] Field of Search ..... 53/281, 282, 276, 37, 53/266, 314, 313, 316, 55, 77; 141/172, 94, 374, 275, 276, 277, 278, 155

[56] References Cited

UNITED STATES PATENTS

| | | | |
|---|---|---|---|
| 2,387,452 | 10/1945 | Lundal et al. | 141/277 X |
| 2,553,250 | 5/1951 | Gross | 141/172 X |
| 2,644,310 | 7/1953 | Detrez | 53/276 X |
| 2,972,216 | 2/1961 | Schmidt | 53/281 |
| 3,064,697 | 11/1962 | Maione | 53/313 UX |
| 3,124,916 | 3/1964 | Anderson et al. | 53/282 X |
| 3,137,982 | 6/1964 | Decker et al. | 53/316 |
| 3,214,887 | 11/1965 | Weller | 53/316 |

*Primary Examiner*—Travis S. McGehee
*Assistant Examiner*—Horace M. Culver

[57] ABSTRACT

An apparatus for high speed filling of containers with product such as ice cream and the like. The apparatus includes a turret driven by power means for moving containers from a feed station to a fill station for filling of the container and then to a capping station for placing a cap on the container and finally to a removal station. A lift is provided to move the containers toward and away from a dispensing nozzle which dispenses product into the containers. Pneumatic control means are provided to cooperate with the lift and a shut-off valve in the dispensing nozzle for independent adjustment of the timing of the operations thereof.

11 Claims, 15 Drawing Figures

METHOD AND APPARATUS FOR FILLING CONTAINERS

In the filling of containers with product, particularly ice cream and the like, it is desirable to have an apparatus and method which will operate at high speed and still fill the containers to desired levels consistently. The present invention relates to such a filling apparatus which is adapted for high speed operation and has control means which are independently adjustable to time and control the various operations of the apparatus relative to one another so as to achieve consistent filling with the filled containers complying with the regulations. The control means provide ease of adjustment of the timing and control of movements not heretofore found in high speed filling apparatus. Prior filling apparatuses have not only lacked the desired adjustments and controls but have also lacked means to detect a jam so as to dump the product to be dispensed without requiring a shut-off of the flow of material which would cause a back-pressure build-up and changes in the consistency and flow properties of the product being dispensed.

The principal objects of the present invention are: to provide an apparatus for filling containers with a product such as ice cream which is automatic in operation and operates at high speed; to provide such an apparatus with control means which control the timing of the various operations of the apparatus; to provide such an apparatus wherein the control means are easily adjustable and each operation's control is adjustable independently of the other operations so that the various operations are timed relative to one another and yet independent of one another; to provide such an apparatus with a jam detecting means which when a jam occurs the product to be dispensed can be dumped; to provide such an apparatus wherein the control means control the filling operation in such a manner as to assure consistent fills of the containers to provide a method of filling the containers which assures consistent filling thereof with product; to provide such a method which is adapted for high speed operation and to provide such a method and apparatus which are well adapted for their intended use, economical and positive in operation.

Other objects and advantages of the present invention will become apparent from the following detailed description taken in connection with the accompanying drawings wherein are set forth by way of illustration and example certain embodiments of the present invention.

Figure 1:
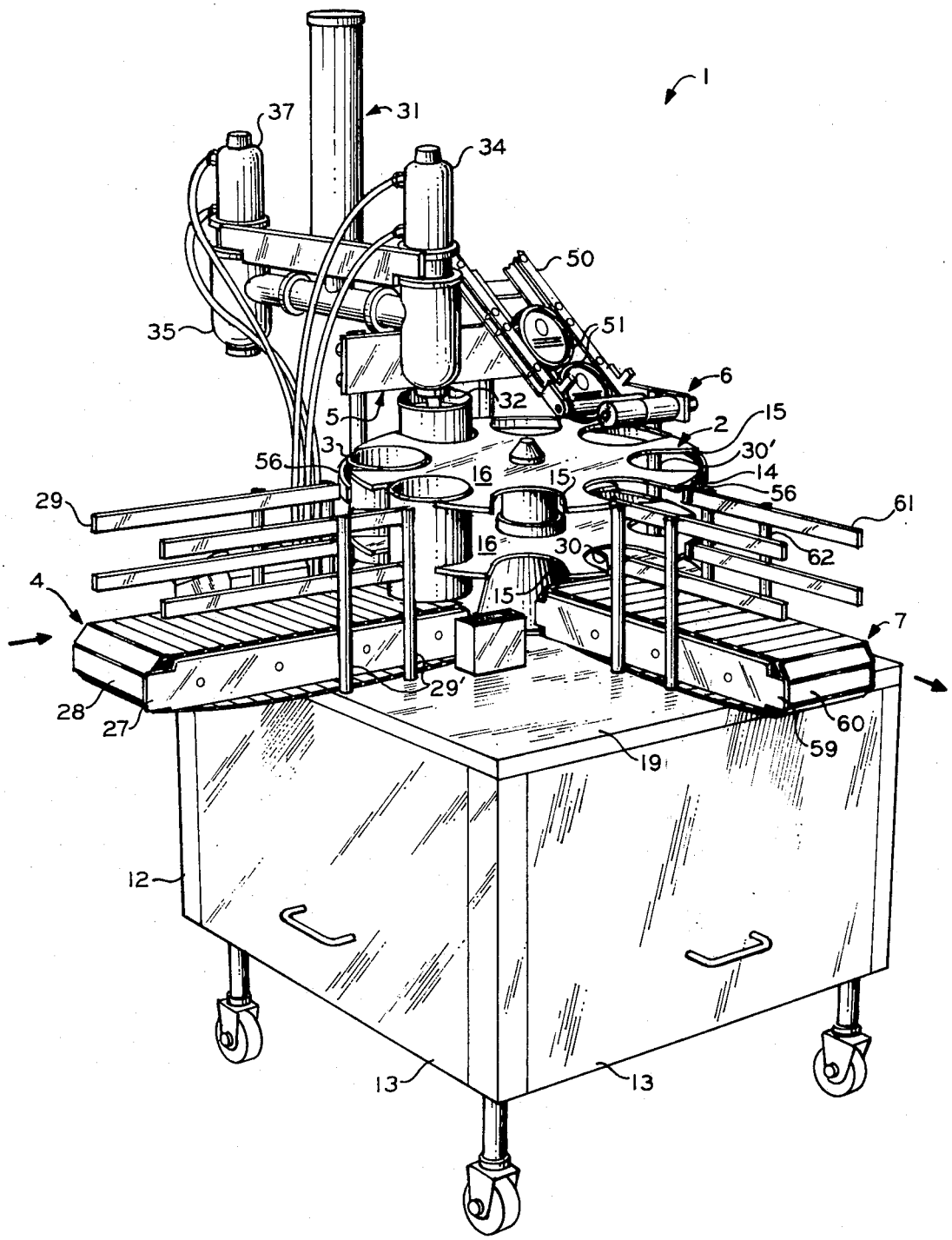
FIG. 1 is a perspective view of a container filling apparatus.
Figure 2:
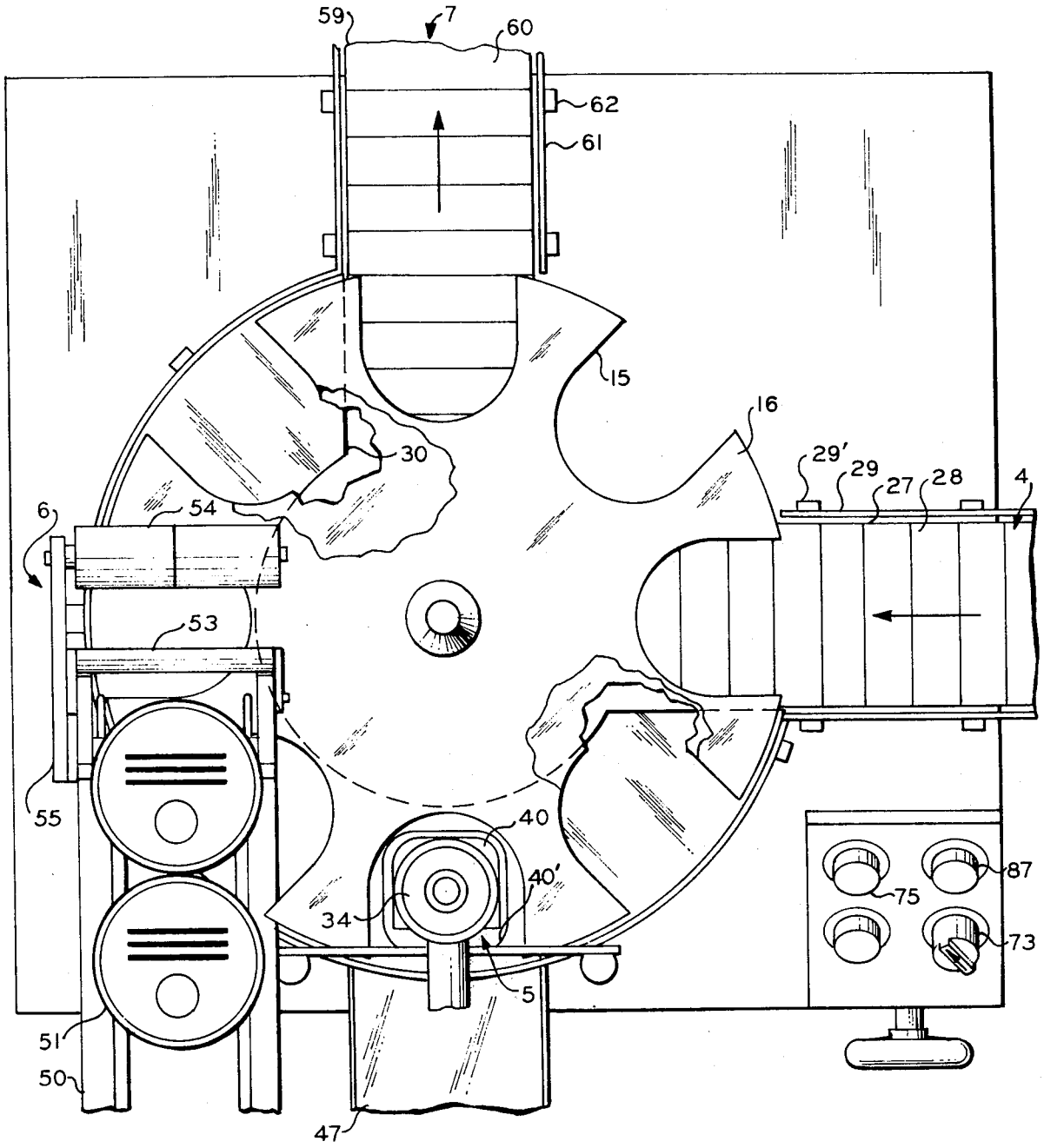
FIG. 2 is a plan view of the filling apparatus.
Figure 3:
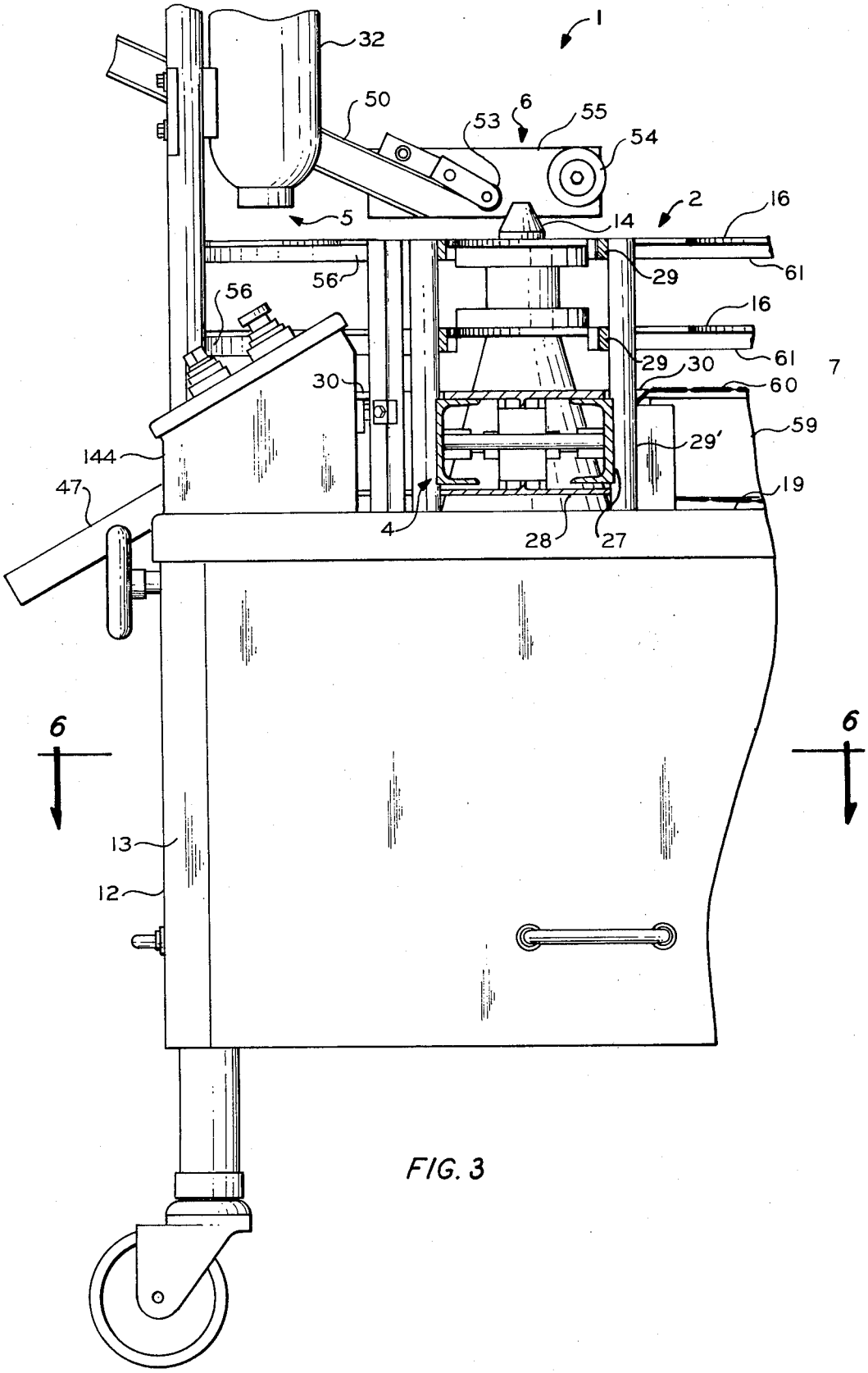
FIG. 3 is a side elevation view of the filling apparatus shown from a container feed side with portions broken away to show structural details.
Figure 4:
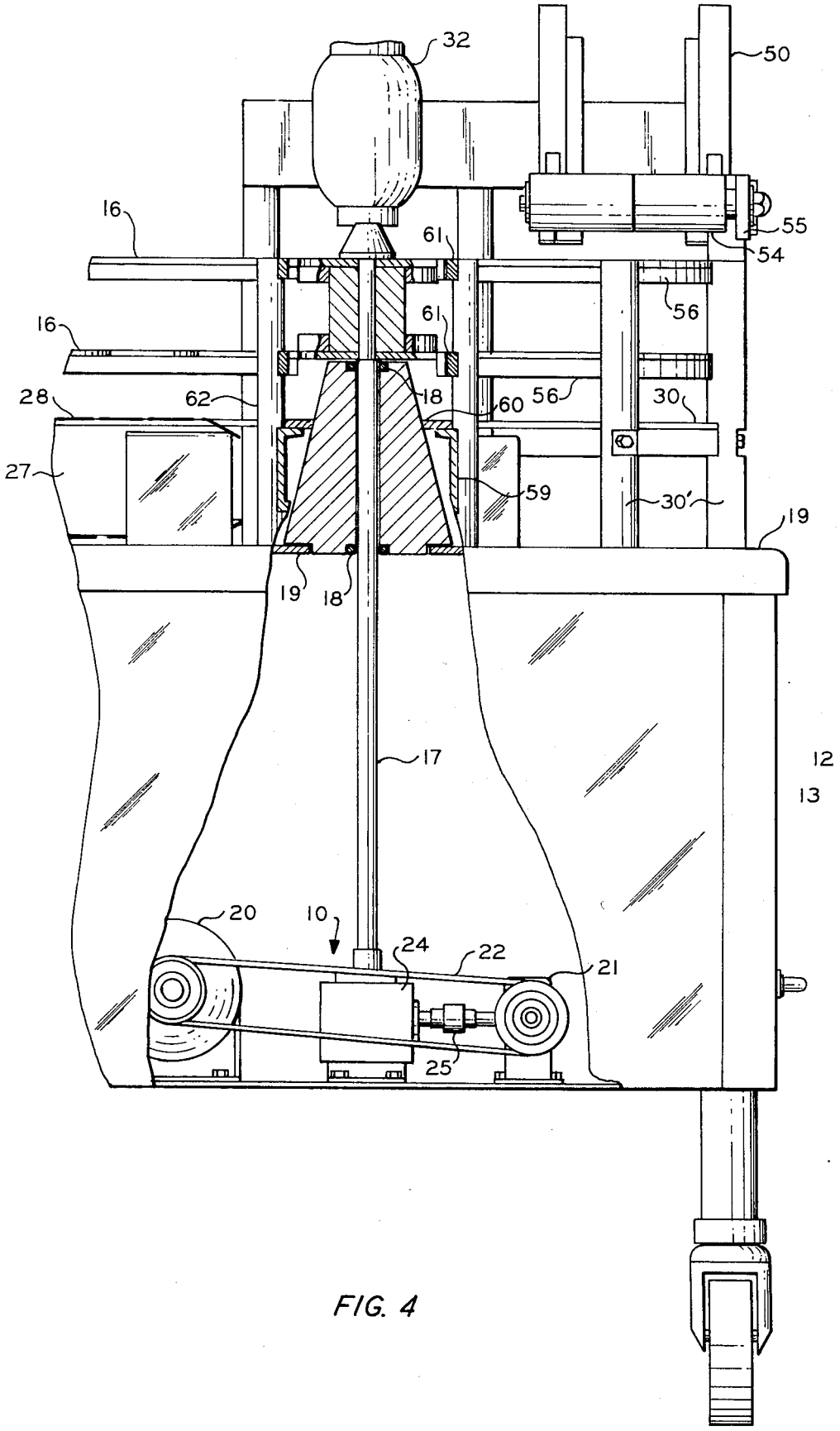
FIG. 4 is a side elevation view of the container-filling apparatus shown from the container removal side thereof.
Figure 5:
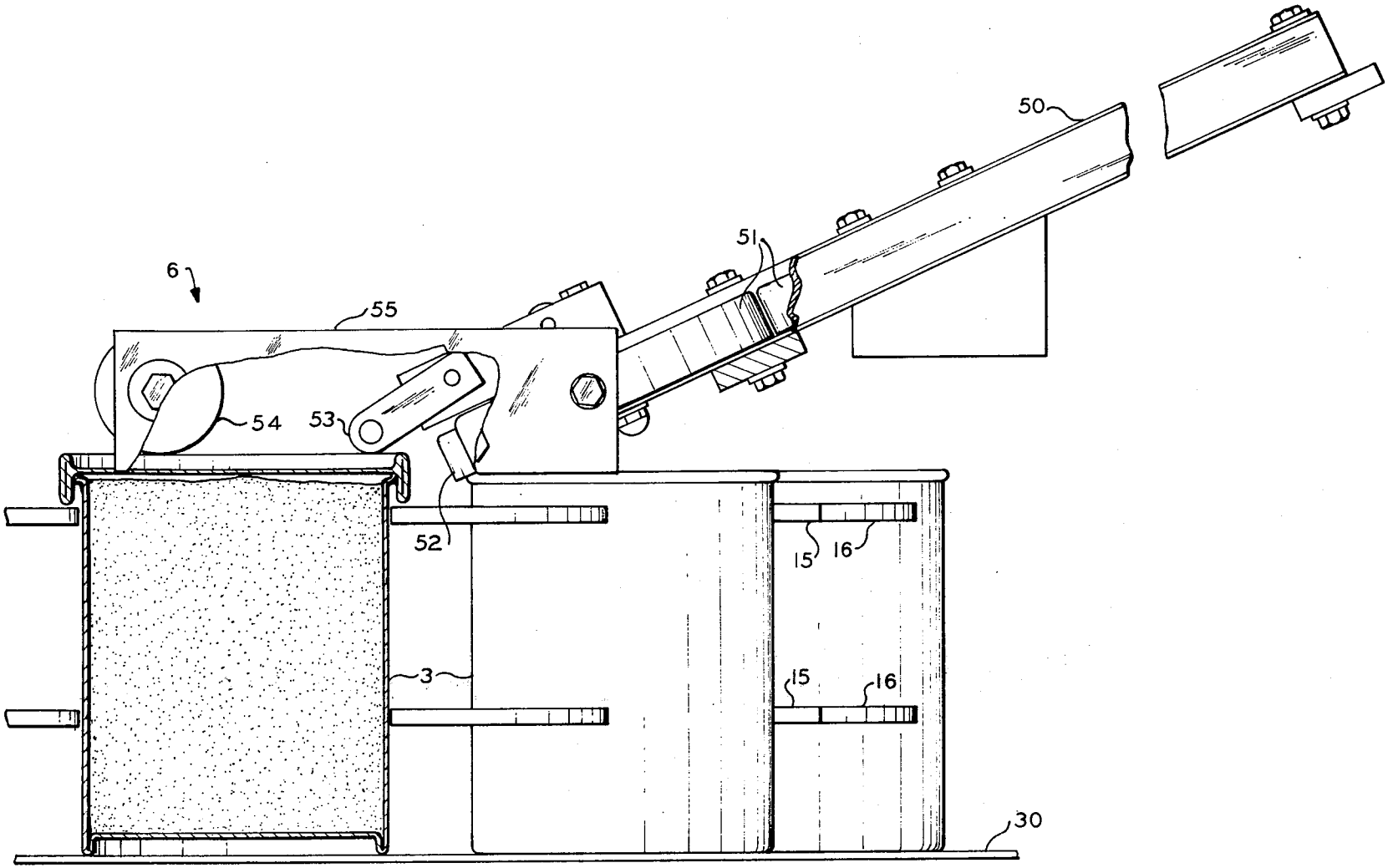
FIG. 5 is an enlarged fragmentary view of a capping station of the container-filling apparatus, same being shown with portions broken away to illustrate structural details thereof.
Figure 6:
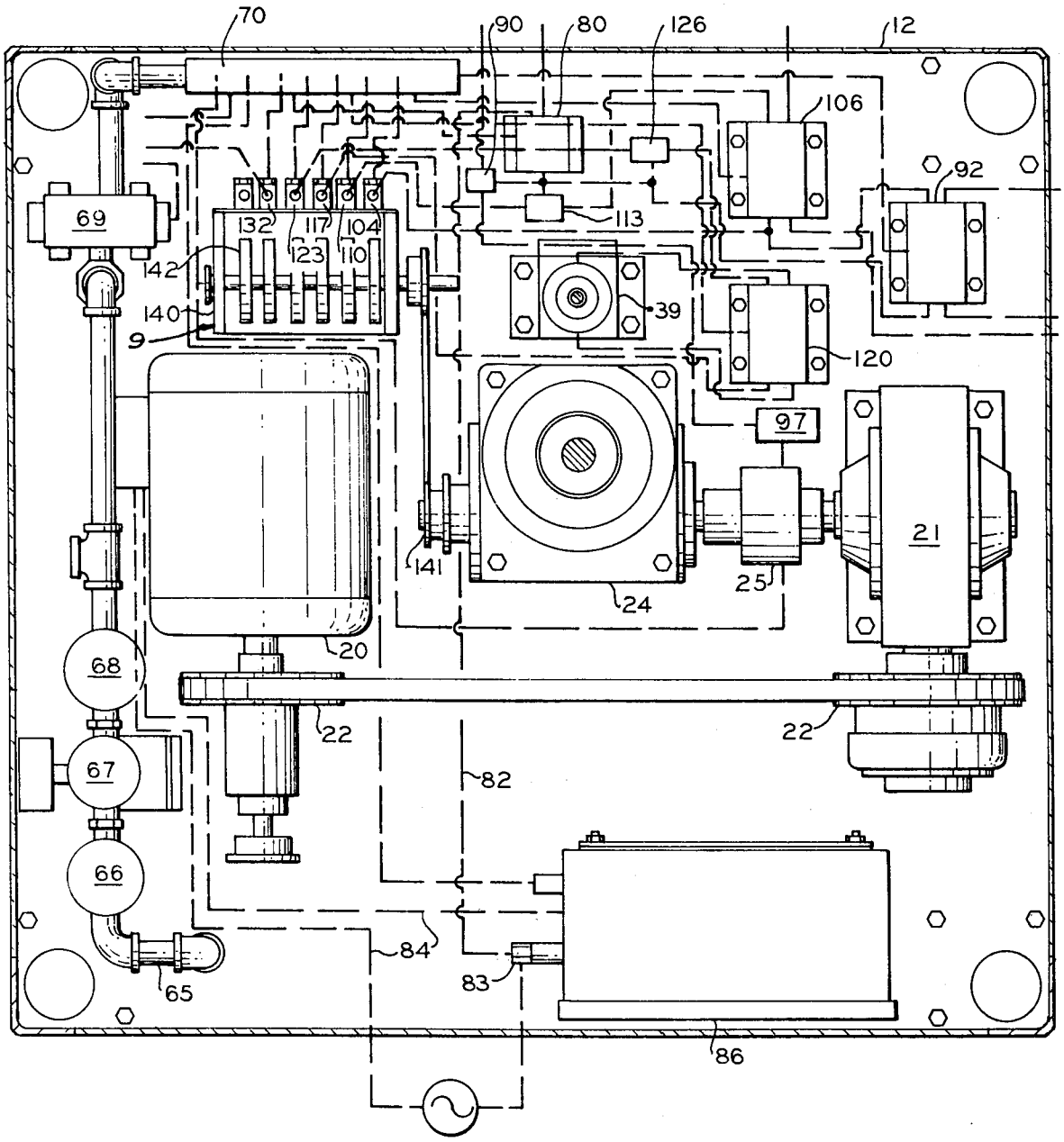
FIG. 6 is a section view of the container-filling apparatus taken along the line 6—6 FIG. 3.
Figure 7:
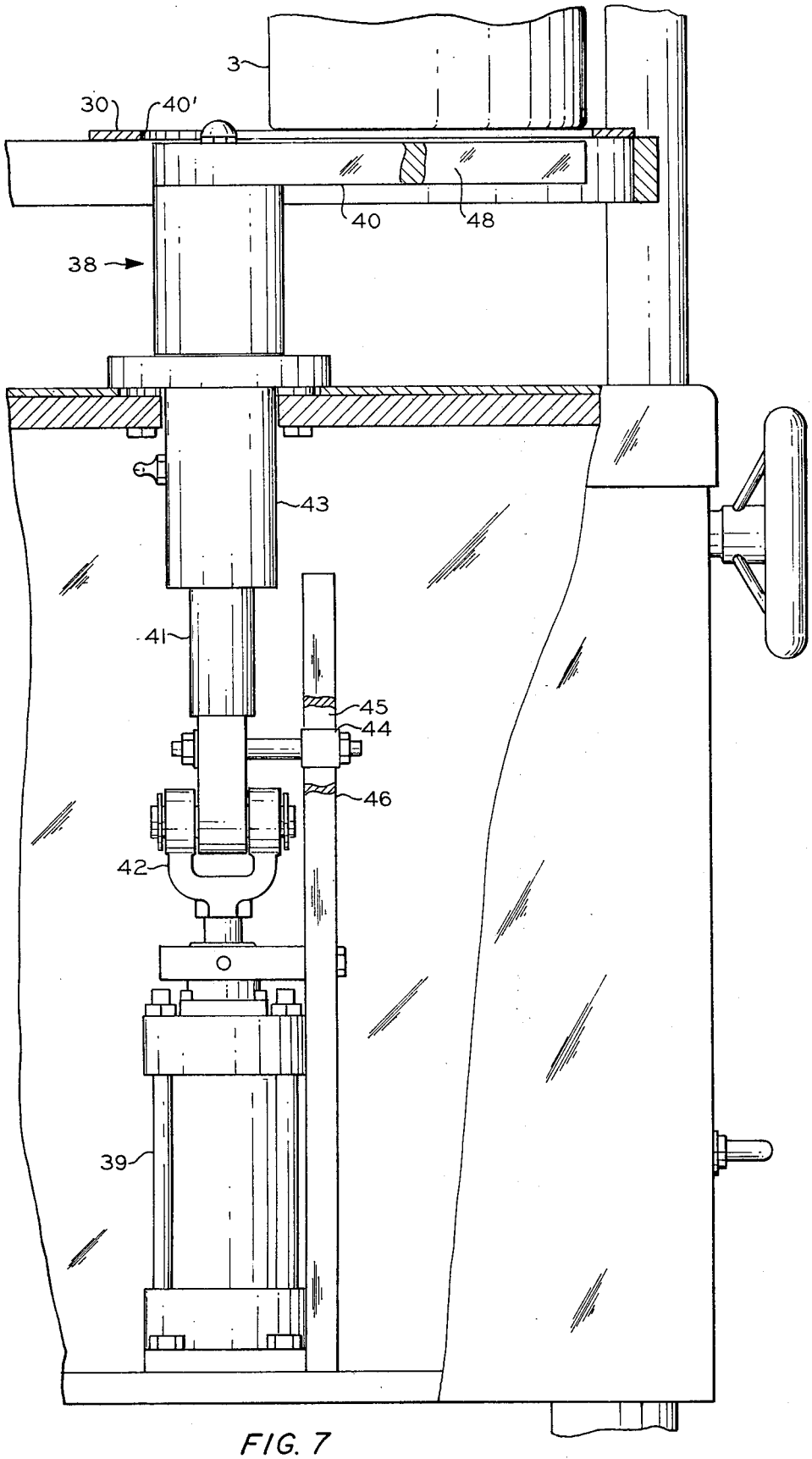
FIG. 7 is an enlarged fragmentary view of a container lift means.

Referring more in detail to the drawings.

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting but merely as a basis for the claims and as a representative basis for teaching one skilled in the art to variously employ the present invention in virtually any appropriate detailed structure.

The reference numeral 1 designates generally a container filling apparatus having transporting or conveying means 2 which move containers 3 from container feed means 4 to a container filling station 5 then to a capping station 6 and finally to a container removal station 7. Control means, generally designated by the reference numeral 9, are operably connected to portions of the filling station to control the timing and movement of portions thereof with the control means being of a type which is easily and independently adjustable. Drive means 10 are operably connected to the conveying means 2 to drive same preferably in sequential steps and at an adjustable rate.

The apparatus 1 includes a frame structure 12 preferably having side panels 13 forming an enclosure to house various component parts of the apparatus. The conveying means 2 in the illustrated structure include a turret arrangement 14 which is preferably rotatable in a horizontal plane and comprised of two spaced apart discs having equally spaced openings or notches 15 extending radially inwardly from the peripheral edge thereof. The discs 16 are spaced apart vertically wherein a container 3 is received within a respective pair of notches 15 with the edge of the lower notch engaging a lower portion of the container and the edge defining the notch in the upper disc engaging an upper portion of the container. The discs 16 are mounted and retained from relative rotation on a shaft 17 which in turn is rotatably mounted in a suitable bearing arrangement 18 and extends downwardly for operable connection with the drive means 10. A top plate 19 forms an upwardly facing table underneath the turret 14 and has the bearing arrangement 18 mounted thereon.

The drive means can be of any suitable type and preferably of a type which will index sequential movement of the turret 14. In the illustrated structure the drive means includes an electric motor 20 mounted in the frame structure 12 and operably connected to a gear reducer 21 preferably by a conventional adjustable sheave and belt drive arrangement 22. The adjustable sheave arrangement 22 permits adjustment of the operating speed of the turret and the output rate of the apparatus 1. The gear reducer and the electric motor 20 are operably connected to an indexing unit for driving of same. In a preferred embodiment of this invention the indexing unit 24 is connected to the gear reducer by a coupling such as an overload sensitive type of a type similar to a Helland Failsafe Coupler. When the coupling 25 senses an overload, same will respond thereto in a manner later described for changing the operation of the apparatus 1. The shaft 17 is operably connected to the indexer 24 for rotation thereby. In the illustrated form, the indexer will move the turret 14 in sequential rotational steps, preferably eight in number, with the turret remaining stationary between each sequential step of movement.

The feed means 4 move containers 3 to a position adjacent the conveying means 2 wherein the containers are individually fed into a pair of notches as same rotate to a position adjacent the feed means 4. Any suitable feed means can be used and, as illustrated, a conveyor 27 is mounted on the top plate 19 with the containers 3 being upstanding thereon and moved therealong by movement of a driven conveyor belt 28. Guardrails 29 are secured to supports 29' which are mounted on the top plate 19 and hold the containers 3 in line and prevent same from falling off the conveyor belt 28. A support floor forming disc 30 is mounted on supports 30' secured to the top plate 19 and is positioned beneath the disc 16 for supporting engagement with the bottoms of the containers 3. The floor 30 extends between the feed means 4, filling stations 5, capping station 6 and the removal station 7. The floor is positioned just below the level of the conveyor belt 28 to provide for smooth movement onto same with the containers 3 sliding on the floor 30 when moved by the turret 14.

The filling station 5 in the illustrated structure includes a dispensing head 31 which is adapted to be connected to a source (not shown) of product such as a source of ice cream and the like. The dispensing head preferably has a dispensing or filling nozzle 32 which is positioned to discharge downwardly at a position adjacent the turret and into a container 3 which is moved by the conveying means 2. The dispensing nozzle 32 has a valve (not shown) therein which is connected to means such as an air cylinder 34 which is operable to open and close the valve in a manner later described. Preferably, the dispensing head 31 also includes a dumping nozzle 35 which is preferably directed downwardly at a position spaced from the apparatus 1. The dumping nozzle 35 is similar to the dispensing nozzle 32 and has a valve (not shown) therein which is operably connected to an air cylinder 37 for operation thereof in a manner to be later described.

The filling station 5 includes lift means 38 which are positioned beneath the dispensing nozzle 32 and are adapted to move a container 3 relative to the dispensing nozzle 32. In the illustrated structure, the lift means includes an air operated extendable ram 39 mounted in the frame structure 12 and being connected to a platform 40 which engages the bottom surface of a container 3 to move same vertically both up and down. The floor 30 has a through opening 40' for allowing the platform 40 to move therethrough with the platform preferably being positioned just below the level of the floor when the platform is in its down position. The platform 40 is mounted on a slide shaft 41 which in turn is connected to the ram 39 by a coupling 42. The shaft 41 is reciprocably received within an enlongate bearing 43 for guiding same during movement. The bearing 43 in the illustrated structure is secured to the top plate 19. To facilitate smooth operation of the lift means 38 and prevent rotation of the platform 40, a second guide means is provided which is shown as including a roller bearing 44 secured to the shaft 41 and received within an elongate guideway 45. The guideway 45 is in a bracket 46 which is all secured to the frame.

The filling station 5 also includes a chute 47 having a bottom wall and side walls with the chute being secured adjacent to the platform 40 and in the event that a container 3 is not positioned beneath the dispensing nozzle 32 when same discharges product, the product will fall onto the chute 47 and by gravity will flow down same to a point of discharge. It is to be noted that the platform 40 has a U-shaped opening 48 for allowing product which is discharged in the absence of a container to flow therethrough and the opening 40' onto the chute 47.

In the illustrated structure, the capping station 6 includes a cap feed chute 50 which is disposed at an angle whereby caps 51 therein move downwardly from a source (not shown) to a position for being placed in sealing engagement on the filled containers. As shown, the leading edge of the containers 3, as they move into the capping station 6, are at a position slightly above a leading edge 52 of the cap 51 whereby movement of the container 3 causes the cap 51 to move therewith by engagement between the leading edges. Further movement of the container moves the cap into engagement with a pressing roller 53 which applies downwardly directed force on the cap 51 urging same onto the open end of the container 3. As shown, the pressing roller 53 is mounted on the feed chute 50 which in turn is secured to the top plate 19. Further movement of the container into the capping station moves the cap 51 into engagement with a second roller 54 which is also mounted on the feed chute by an arm 55. The second roller 54 engages the cap 51 and when the container 3 and cap 51 move thereunder pushes the cap 51 fully onto the container 3.

Guiderails 56 are secured to support posts 30' which are secured to the top plate 19 with the guiderails extending around the periphery of the discs 16 between the feed means 4 and the removal station 7 and prevent the containers 3 from moving out of engagement with the notches 15 by centrifugal force.

The apparatus 1 is provided with a removal station 7 to remove the filled containers from the turret 14. Any type of removal device can be used and, as shown, a conveyor 59 is mounted on the top plate 19 and is positioned adjacent to the turret 14 and has a driven conveyor belt 60 which is positioned just slightly below the floor 30 whereby as the disc 16 rotates the filled container will be moved onto the conveyor belt 60 which is moving and carries the filled container away from the turret 14. The conveyor 59 has side guiderails 61 positioned on opposite sides thereof to guide the filled containers during removal. The guiderails 61 are secured to upright supports 62 which are secured to the top plate 19.

The apparatus 1 is provided with means to control the timing of movement of various component parts thereof and preferably the means includes an air logic control system. The air logic control system is connected to the cylinders 34 and 37 and the ram 39 for supplying compressed air thereto at the proper time for operation thereof and has the various component parts, described below, mounted in the frame structure 12. An inlet line 65 connects the source 64 to the system and preferably has connected in series a filter 66, a pressure regulator 67 and an oiler or lubricator 68. A main line shut-off valve 69 is connected to the inlet line 65 and has a main supply line 70 connected on the downstream side thereof. The main supply line 70 can be in the form of a manifold mounted on the frame structure 12 to facilitate assembly. The valve 69 has means connected thereto for operation to selectively move same between an open position and a closed position. As shown, the line 71 is connected to the lines 65 upstream of the valve 69 and is also connected to an off/on master valve 72 which when shifted to an open position by a control handle 73 the valve 72 moves to an open position and supplies pilot pressure through a pilot line 74 to a pilot port of the valve 69 to shift same to its open position. It is desirable to supply the air system with an indicator such as a light-on indicator 75 which shows when the main supply line 70 is pressurized.

The air system is further provided with means which are operable to effect starting of the motor 20. In the illustrated form, these means include a start valve 77 preferably of the spring return pushbutton type which is connected to the main supply line 70 by a line 78. A pilot line 79 connects the downstream side of the valve 77 to a pilot operated valve 80. The pressure side of the valve 80 is connected to the main supply line 70 by a line 81 whereby when the valve 77 is opened pilot pressure is supplied through the line 79 shifting the valve 80 to an open position whereby pressurized air flows through the valve 80 and through a line 82 to a pressure-sensitive switch 83 which is electrically connected to the motor 20 by conductors 84. The motor includes a relay starter 86 electrically connected thereto. The valve 80 requires only a pulse for operation. The pulse of air supplied by the valve 77 shifts the valve 80 to an open position with same remaining in the open position until a second pulse of air is supplied through a pilot line 85 which is also connected to the valve 80 with the pulse being supplied in a manner later described.

The control system is provided with means to stop functioning of the apparatus and dispensing of product. As shown, these means include a stop circuit which is preferably operable manually and automatically when the apparatus is jammed or otherwise overloaded. A valve 87 preferably of the push-button, spring return type is connected to the main supply line 70 by a line 88 and on the downstream side of the valve 87 a pilot line 89 connects the valve 87 to a shuttle type valve 90. A second pilot line 91 is connected to the outlet port of the valve 90 and to a valve 92 such as a four-way double pilot operated valve to selectively supply pilot pressure to one side thereof. The valve 92 is connected to the main supply line 70 by a line 93. The valve 92 is connected to the cylinder 37 by lines 94 and 95 wherein when the valve is in one position, pressurized air is supplied to the line 94 to retract the cylinder and air is supplied through the line 95 to extend the cylinder. Pilot pressure air supplied to the line 91 shifts the valve 92 whereby pressurized air is supplied to the line 94 to retract the cylinder and open the valve in the dumping nozzle 35.

The apparatus stop circuit preferably includes a valve 97 which is connected to the main supply line 70 by a line 98 with the valve 97 preferably being mounted adjacent to the overload sensing coupling 25 for operation thereby. The outlet port of the valve 97 is connected to one side of the valve 90 by a pilot line 99 whereby when an overload is detected by the coupling 25 same will actuate the valve 97 which is preferably of a spring-return, push-button type by the coupling 25 having a pin which moves outwardly from the coupling when same is overloaded to engage the actuator of the valve 97. Upon actuation of the valve 97, pilot pressure supplied to the valve 90 and the valve 92 which causes the cylinder 37 to retract and the valve in the dumping nozzle 35 to open as described previously. Upon supplying pilot pressure to the line 91 by actuation of either of the valves 87 or 97, pilot pressure is also supplied to the line 85 which will effect shifting of the valve 80 to a closed position and shutting off of air to the line 82 whereby the switch 83 is closed and the motor 20 is turned off.

Means are provided in the control system to effect operation of the valve in the dispensing nozzle 32. The means includes a pilot operated valve 100 which is connected to the main supply line 70 by a line 101. The valve 100 is double pilot operated having one side thereof connected to the pilot line 79 and the other side thereof connected to the pilot line 85 by a pilot line 102. Operation of the valve 77 supplies pilot pressure to the valve 100 shifting same to a position wherein compressed air is supplied through the valve to a line 103 which is connected to a valve 104 which is preferably of a cam operated type such as a three-way valve such as a Clippard MJV-3 valve. Upon operation of valve 104 in a manner hereinafter described, the valve 104 opens and supplies pilot pressure to a line 105 which is connected to the outlet port of the valve 104. The line 105 is connected to one side of the valve 92 and to one side of a valve 106 which is similar to the valve 92. The valve 106 is connected to the main supply line 70 by the line 93 and has two outlet ports connected to the cylinder 34 by lines 108 and 109. When pilot pressure is supplied to the line 105, the valve 106 is shifted whereby compressed air is supplied through the line 108 to the cylinder 34 to retract the cylinder and move the valve in the dispensing nozzle 32 to an open position for the dispensing of product through the nozzle. The pilot pressure in the line 105 also shifts the valve 92 to a position wherein compressed air is supplied through the line 95 to extend the cylinder 37 and close the valve in the dumping nozzle 35 to prevent the flow of product therethrough.

A valve 110 which preferably is similar in construction and operation to the valve 104 is connected to the main supply line 70 by a line 111 and has a pilot line 112 connected to the outlet port and to a valve 113 which preferably is similar in construction and operation to the valve 90. The line 112 is connected to one side of the valve 113 and a pilot line 114 is connected between the line 85 and the other side of the valve 113. Opening of the valve 110 in a manner hereinafter described supplies pilot pressure to the line 112 shifting the valve 113 and supplying the pilot pressure through the valve to a pilot line 115 which is connected between the valve 113 and the one side of the valve 106. The pilot pressure supplied to the line 115 shifts the valve 106 wherein compressed air is supplied through the valve 106 to the line 109 to extend the cylinder 34 and close the dispensing nozzle. If either of the stop valves 87 and 97 are opened then pilot pressure is supplied through the line 114 to shift the valve 113 and supply pilot pressure to the line 115 to also close the valve in the dispensing nozzle 32 to prevent the discharge or dispensing of product therefrom.

A valve 117 which preferably is similar in construction and operation to the valve 104 is connected to the main supply line 70 by a line 118 and has a pilot line 119 connected to the outlet port thereof and to one side of a valve 120 which preferably is similar in construction and operation to the valve 92. The valve 120 is connected to the main supply line 70 by the line 93 and outlet ports of the valve are connected to the lift ram 39 by lines 121 and 122. Upon opening of the valve 117 in a manner hereinafter described, pilot pressure is supplied to the line 119 shifting the valve 120 whereby pressurized air flows through the valve 120 through the line 121 to the lift ram to extend same and raise the platform 40. A valve 123 which preferably is similar in construction and operation to the valve 104 is connected to the main supply line 70 by a line 124 and has a pilot line 125 on the outlet port and connected to a valve 126 which preferably is similar in construction and operation to the valve 90. Opening of the valve 123 in a manner as hereinafter described provides pilot pressure to the line 125 and to a line 127 which is connected to the outlet port of the valve 126 and one side of the valve 120. Opening of the valve 123 supplies pilot pressure to the line 127 to shift the valve 120 to a position whereby pressurized air flows through the valve 120 and the line 122 to retract the ram 39 and lower the platform 40. A line 128 connects one side of the valve 26 to the pilot line 85 whereby upon opening of either of the valves 87 or 97, pilot pressure is supplied through the valve 126 and to the line 127 to shift the valve 120 as described above to supply pressurized air to the line 122 to lower the platform 40.

It can be seen from the above description of the control system that opening of either of the valves 87 or 97 will effect opening of the valve in the dumping nozzle 35 so that product can flow therethrough and closing of the valve in the dispensing nozzle 32 to prevent discharge of product therethrough. Opening of either of the valves also lowers the platform 40 and turns off the motor 20. The opening of the valves 87 or 97 can be due to an overload detected by the coupling 25 or when it is desired to terminate operation of the apparatus 1. It is to be further noted that the valves 92, 106 and 120 each have variable flow restricters 130 connected to exhaust ports of the valves to control the rate of air flow out of the exhaust side of the cylinders controlled by the respective valves so as to control the rate of movement thereof.

The control system and the apparatus 1 can optionally be provided with means (not shown) which are adapted to dispense product such as nuts and the like into a filled container 3. The control system in this instance would include a valve 132 which preferably is similar in construction and operation to the valve 104 and is connected to the main supply line 70 by a line 133. The outlet port of the valve 132 is connected to a pressure switch 134 by a pilot line 135 whereby opening of the valve 132 in a manner hereinafter described closes the switch 134 for operation of a device such as a motor 136 which drives a nut dispenser or the like.

The valves 104, 110, 117, 123 and 132 are preferably of a spring return type and are adapted to be operated by a cam drive unit 140 to control opening and closing thereof at timed intervals which are independently adjustable relative to one another. The valves are mounted on pneumatic programmer or cam unit 140 such as a Minimatic Sequence Programmer with the cam unit being mounted on the frame structure 12. Preferably the cam unit 140 is operably connected to the indexer 24 by drive means such as a sprocket and chain arrangement 141 so that the cam unit operates in time with the rotation of the turret 14. The cam unit 140 has a plurality of cams 142 which engage operator portions of the valves 104, 110, 117, 123 and 132 to effect opening. The cams 142 are exposed so as to be adjustable in phase to control when the valves are pulsed open making the cylinders 37, 34 and 40 and optionally the motor 136 operate at adjustable timed intervals with the timed operations being independently adjustable.

Figure 8:
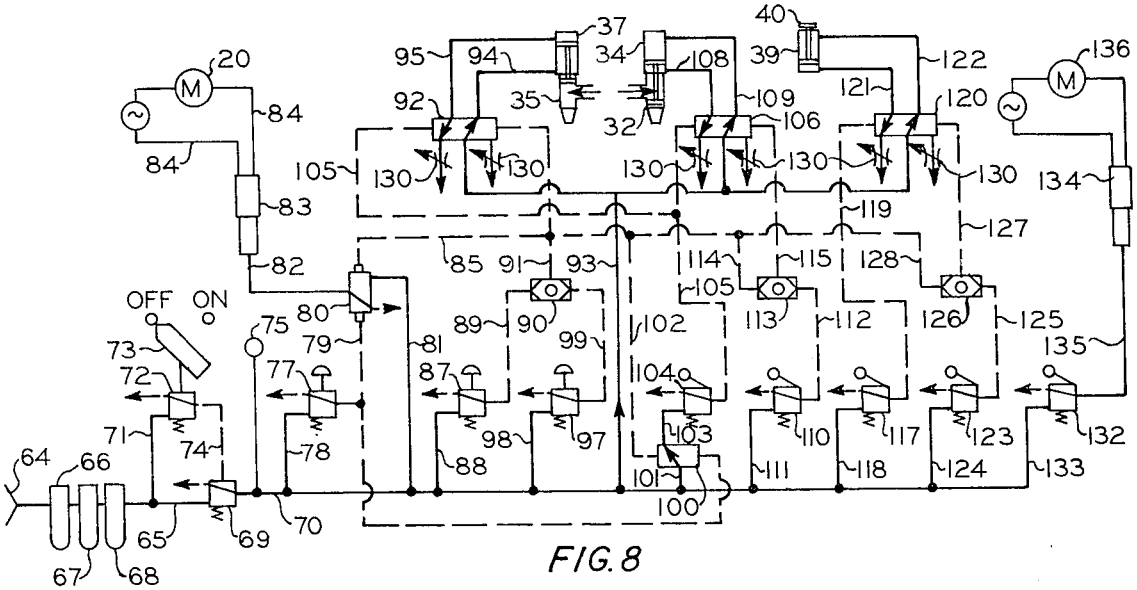
FIG. 8 is a schematic view of control means showing same in a neutral or nonoperating condition.
Figure 9:
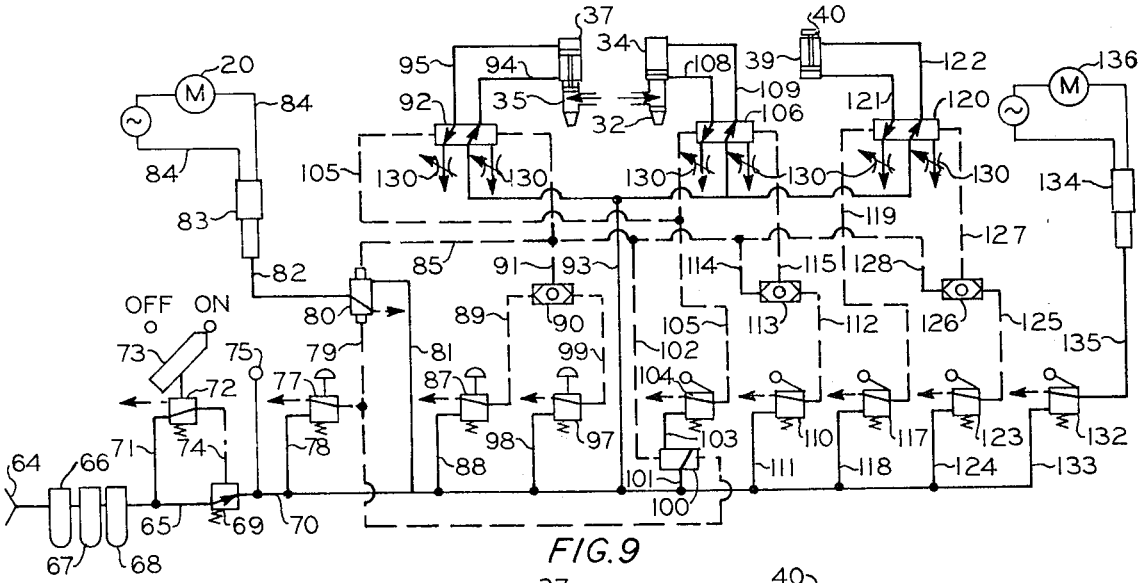
FIG. 9 is the schematic of the control means showing same in a first phase of operation.
Figure 10:
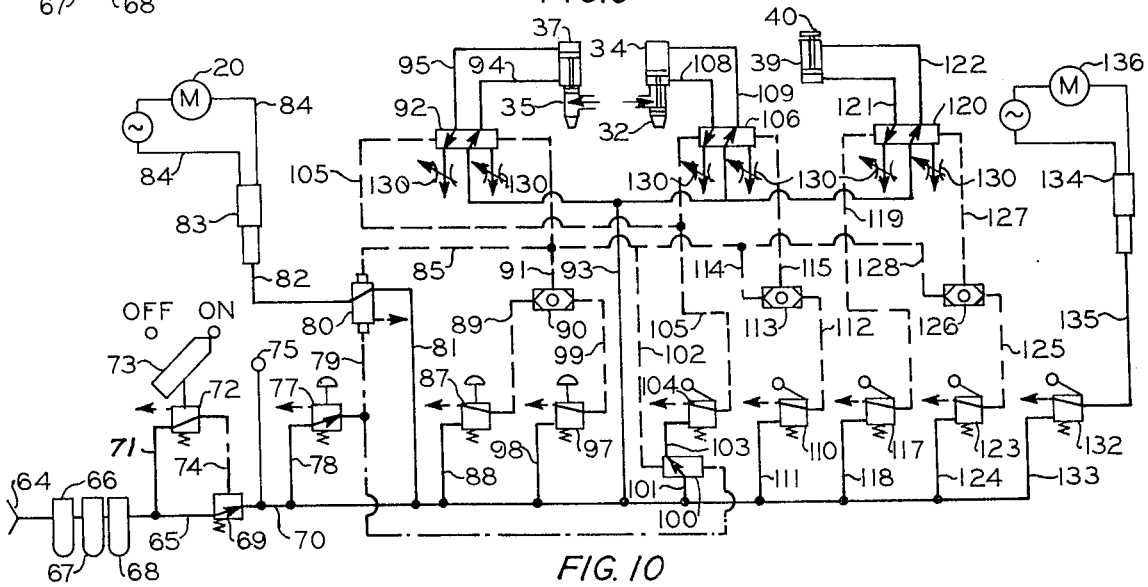
FIG. 10 is a schematic view of the control means showing same in a second phase of operation.

The present invention is more fully understood by a description of the operation thereof. Containers are fed to the turret by the feed means 4. The handle 73 and the actuator for the valve 87 and 77 are mounted on a control panel 144 which is secured to the top plate 19. With the container feed means 4 being loaded with containers 3, operation of the apparatus 1 can be commenced. The master control valve 72 is opened and the main supply line is pressurized. The valve 77 is opened and provides a pulse of air so as to start the motor 20 and open the valve 100. The control system in its non-operational condition is best seen in FIG. 8 wherein solid lines indicate pressurized or flow lines and broken lines indicate pressurized pilot lines and dashed lines indicate non-functioning lines which coding is carried through on the various figures of the schematics. FIG. 9 illustrates the schematic after the valve 72 is opened and FIG. 10 illustrates the schematic with the valve 77 open.

Figure 11:
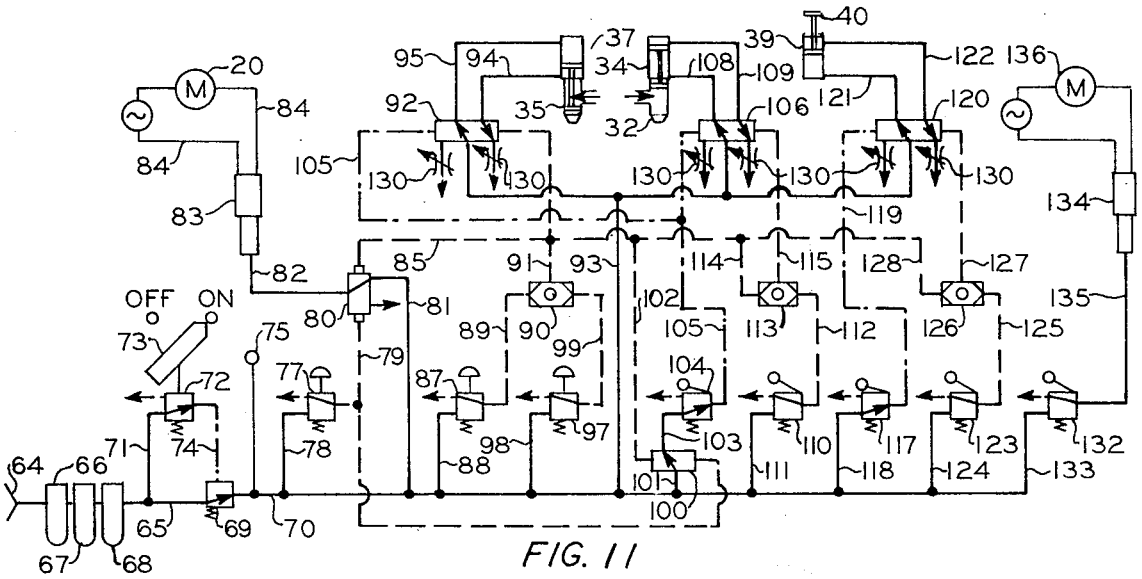
FIG. 11 is a schematic view of the control means showing same in a third phase of operation.
Figure 12:
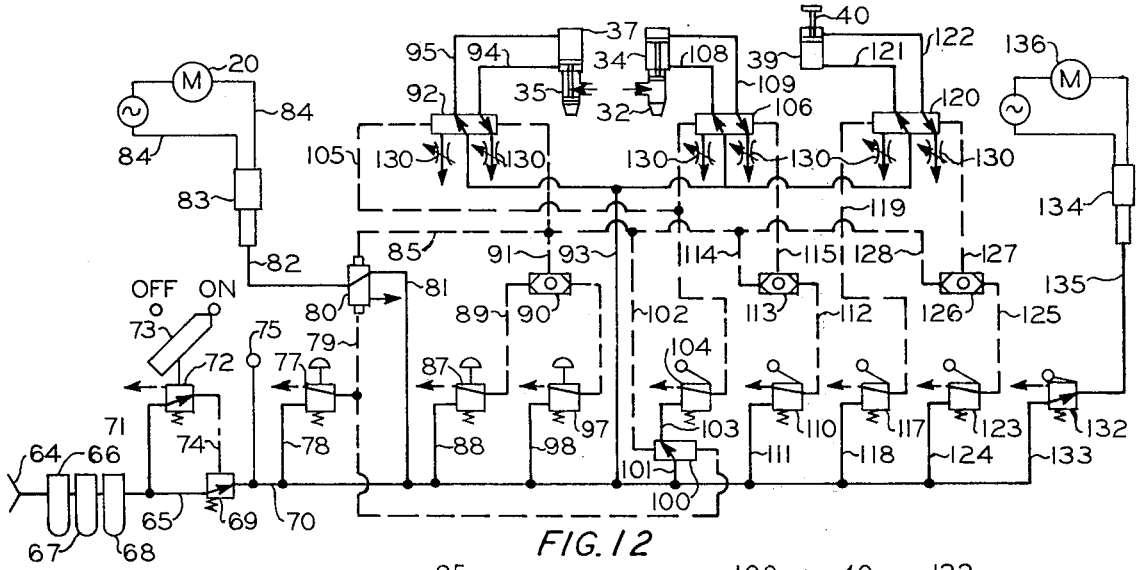
FIG. 12 is a schematic view of the control means showing same in a fourth phase of operation.
Figure 13:
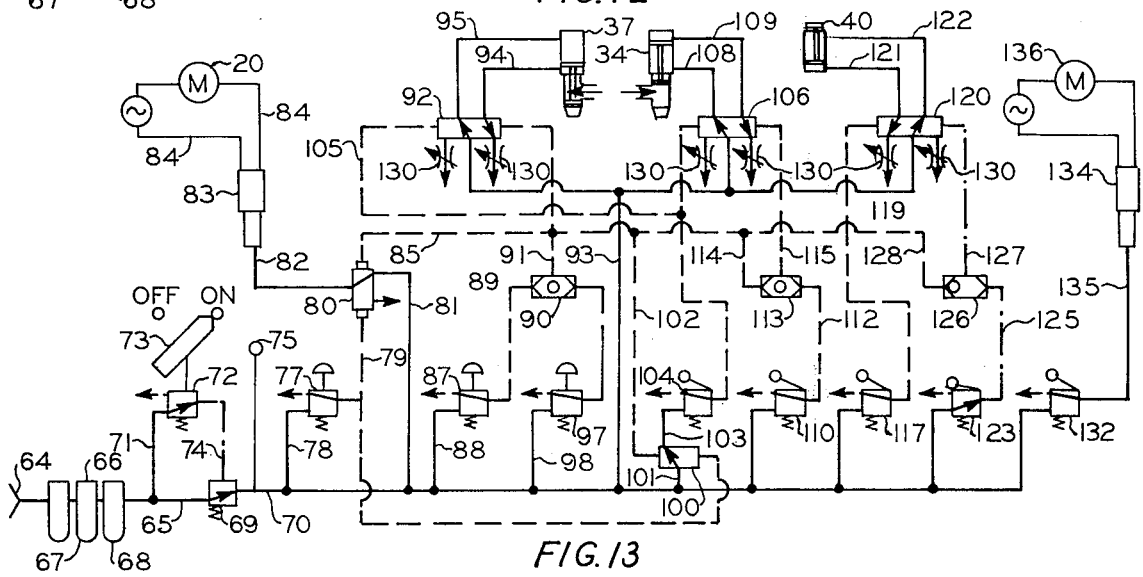
FIG. 13 is a schematic view of the control means showing same in a fifth phase of operation.
Figure 14:
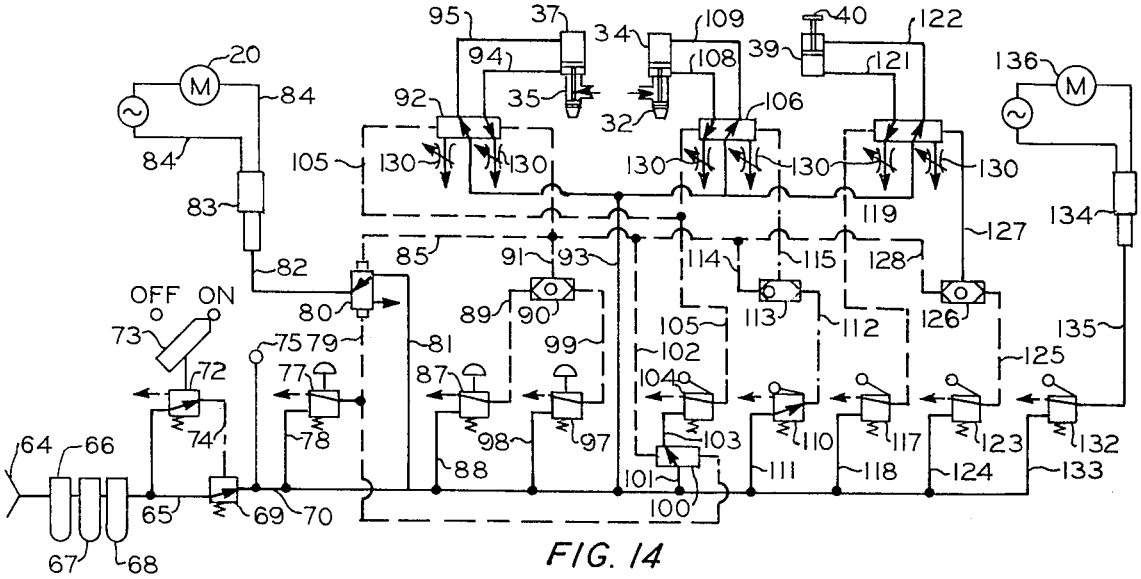
FIG. 14 is a schematic view of the control means showing same in a sixth phase of operation.

With the motor 20 running after the valve 77 is pulsed open, the turret 14 rotates and the cam unit 140 is being driven. The indexer 24 sequentially rotates the turret 14 preferably making eight indexes during one revolution of the turret. The cam unit 140 is driven at such a speed so as to make one revolution for each sequential step or index of rotation of the turret 14. As the cam unit begins to rotate the valve in the dump nozzle 35 is open and the valve in the dispensing nozzle 32 is closed. Referring to FIG. 11, the machine 1 is running and with a container 3 being positioned on the platform 40 the cams have rotated approximately 115° of one cycle. The cam for the valve 117 contacts the actuator and opens the valve providing pilot air to the valve 120 to shift same so as to extend the ram 39 and raise the platform and container at a rate controlled by a variable restricter 130. The container is raised to a position with the nozzle 32 being at a position lower than the upper edge of the container. Still referring to FIG. 11, the cams have traveled approximately 120° of their cycle and the cam for valve 104 contacts the actuator of the valve 104 to open same and simultaneously provides pilot air to the valve 106 to retract the cylinder 34 and open the valve in the dispensing nozzle 32 and to valve 92 to extend the cylinder 37 and close the valve in dumping nozzle 35. The cams have rotated approximately 160° of their cycle as seen in FIG. 12. Optionally, the cam for valve 132 contacts the actuator for valve 132 delivering air to pressure switch 134 starting motor 136 of a decorator feeder to deliver nuts for 30° of the cycle. Referring now to FIG. 13, the cams have traveled 330° of the cycle. The cam for valve 123 contacts the actuator for valve 123 to provide pilot air to valve 120 to shift same as to to retract the ram 39 and lower the platform at a rate controlled by variable restricter 130. Now referring to FIG. 14, the cams have traveled approximately 345° of their cycle. The cam for valve 110 contacts the actuator of the valve 110 to open same and supply pilot pressure to the valve 106 to shift same so as to supply pressurized air to the cylinder 34 to extend same and close the valve in the dispensing nozzle 32 to shut off the flow of product. Opening of the valve 123 is timed to open when the product level has reached a level in the container being filled to a level approximately one quarter of an inch beneath the end of the dispensing nozzle 32. The variable restricter 130 controlling the rate of downward movement of the platform 40 is adjusted to maintain the downward movement of the platform 40 at a rate such as to maintain the spacing between the end of the dispensing nozzle 32 and the product level at a constant spacing preferably approximately one quarter inch until flow of product is terminated. The closing rate of the valve in the dispensing nozzle 32 is controlled by a variable restricter valve 130 so that when approximately 97 percent of the total volume of product has been dumped through the dispensing nozzle and the product level is even with the top of the container 3, the remaining 3 percent form the product peak. By controlling the closing rate of the valve in the dispensing nozzle 32 a clean breakaway of the product is accomplished with no tailing. The peak is desirable when a closure having a window portion is used so that the ice cream makes contact with the window preventing the formation of ice crystals by the elimination of air space in the top of the container. After the container 3 has been filled with product and lowered completely by the platform 40 the above cycle is repeated after the turret has indexed one-eighth or 45° of one revolution.

The filled containers in turn are moved through the capping station 6 as described above for placing of caps on the container 3. After capping and in turn, the filled and capped containers are moved from the capping station to the removal station 7 where same are removed by the conveyor 59.

Figure 15:
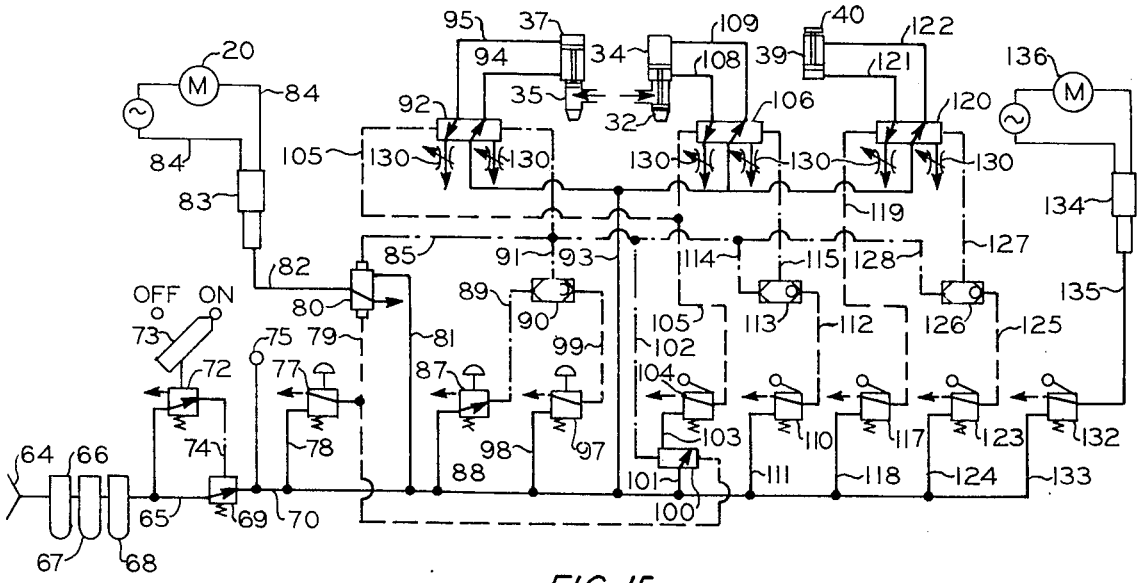
FIG. 15 is a schematic view of the control means showing same in a seventh phase of operation.

As best seen schematically in FIG. 15, when it is desired to terminate operation of the apparatus 1 the valve 87 is opened by depressing its actuator button thereby supplying pilot pressure to the line 91 and 85 and turning off power to the motor 20 and ceasing operation thereof. The valve in the dump nozzle 35 is opened and the valve in the dispensing nozzle 32 is closed by shifting the valve 106 through pilot pressure supplied through line 114, valve 113, and line 115. Pilot pressure is supplied to the line 127 and shifts the valve 120 to lower the platform 40 thereby turning off the apparatus 1 and ceasing its operation and still allow product to be dumped through the dumping nozzle 35. In the event that an overload is sensed by the coupling 25, the valve 97 is opened and turns the apparatus 1 off in the same manner as opening of the valve 87 accomplishes.

It is to be noted that by having a dumping nozzle 35 function as described above, back pressure is substantially reduced or eliminated in the source of product which could be ruined by excessive back pressure and lack of flow. It is to be further noted that in the event that a container 3 is not positioned beneath the dispensing nozzle 32 when same is opened and dispensing, the product discharge will pass through the platform opening 48 and on to the chute 47 and into a suitable receptacle (not shown).

It is to be understood that while I have illustrated and described certain forms of my invention, it is not to be limited to the specific form or arrangement of parts herein described and shown.

I claim:

1. An apparatus for filling containers with product such as ice cream or the like, said apparatus including:

a. a support structure;

b. a container transporting means mounted on said support structure for sequentially moving containers;

c. a container feed station adjacent said transporting means for feeding containers to said transporting means;

d. a container fill station having means for dispensing product from a source into containers moved by said transporting means, said dispensing means includes a downwardly directed nozzle with said nozzle having a pneumatically operated valve member cooperating therewith and operable to selectively close same and prevent flow of product therefrom and includes means remote from said nozzle selectively operable for dumping of product instead of filling a container;

e. a container capping station adjacent said transporting means for placing caps on said containers after same have product dispensed therein;

f. conveying means adjacent said transporting means for removing containers with caps thereon therefrom;

g. a movable platform mounted on said support structure adjacent said fill station and below said nozzle and being selectively movable toward and away from said nozzle;

h. power operated moving means mounted on said support structure and cooperating with said platform for selectively moving same; and i. control means cooperating with said dispensing means and said moving means and operable for controlling timing of the operations thereof relative to one another, said control means is adjustable and includes an air logic circuit with a pneumatic programmer operably connected to said pneumatic valve member and said dumping means and the air logic circuit is operable for changing relative timing of the controlled operations.

2. The filling apparatus as set forth in claim 1 wherein said transporting means includes:

a. power drive means;

b. an indexer operably connected to said power means; and c. a turret mounted on said indexer and sequentially rotatable thereby, said turret having a plurality of circumferentially spaced container receiving openings substantially equally spaced apart, said turret being generally horizontally disposed and rotating about a generally vertical axis.

3. The filling apparatus as set forth in claim 2 wherein said power drive means includes:

a. an electric motor; and b. a variable speed drive operably connecting said motor to said indexer.

4. The filling apparatus as set forth in claim 2 wherein:

a. said drive means includes an overload sensing device;

b. said filling station includes a dump valve selectively openable to dump product; and c. said control means includes power means operably connected to said dump valve and a valve connected to said power means and cooperating with said overload sensing device for operation thereby whereby operation of said valve opens said dump valve for discharge of product therethrough.

5. The filling apparatus as set forth in claim 1 wherein said moving means includes:

a. an extendable pneumatic ram operably connected to said programmer, said ram extending to move said platform upwardly and a said container toward said nozzle and retracting to move said platform downwardly and said container away from said nozzle; and b. an adjustable flow control valve regulating at least one of flow into said ram and out of said ram to adjustably control the rate of movement of said platform away from said nozzle.

6. An apparatus for filling containers with product such as ice cream or the like, said apparatus including:

a. a support structure;

b. a container transporting means mounted on said support structure for sequentially moving containers, said transporting means includes a turret operably connected to power drive means;

c. a container feed means adjacent said transporting means and operable for feeding containers to said transporting means;

d. a container fill means for dispensing product from a source into a container moved by said transporting means, said fill means includes a dispensing nozzle with a pneumatically operated valve operable to selectively stop flow of product from said nozzle;

e. a platform mounted on a pneumatic ram which is mounted on said support structure with said platform being positioned adjacent and below said nozzle, said platform is selectively movable toward and away from said nozzle;

f. a container capping means adjacent said transporting means and operable for placing a cap on a filled container; and g. pneumatic control means operably connected to said pneumatic valve and said pneumatic ram and operable for controlling timing of the operations thereof relative to one another, said control means includes a pneumatic programmer which has exposed cams which are adjustable in phase for changing relative timing of the controlled operations.

7. The apparatus as set forth in claim 6 including:

a. first means associated with said drive means and said control means and operable to sense a jamming of movement of said turret.

8. The apparatus as set forth in claim 7 wherein:

a. said drive means includes a driving motor and said first means is operably connected to said motor to turn same off when a jam is sensed.

9. The apparatus as set forth in claim 6 including:

a. a second nozzle remote from said nozzle, said second nozzle has a second pneumatically operated valve operably connected to said control means for selective operation thereof for dumping of product instead of filling a said container.

10. The apparatus as set forth in claim 9 including:

a. first means associated with said drive means and said control means and operable to sense an overload of said drive means.

11. The apparatus as set forth in claim 10 wherein:

a. said drive means includes a driving motor and said first means is operably connected to said motor and said control means and is operable when an overload is sensed to turn off said motor, close the valve in said nozzle and open the valve in said second nozzle.

* * * * *